United States Patent [19]

Kessler

[11] Patent Number: 4,844,478

[45] Date of Patent: Jul. 4, 1989

[54] RACKET GAME FOR BEACH AND KIT THEREFOR

[76] Inventor: Milton Kessler, 6690 Harrington Ave., Youngstown, Ohio 44512

[21] Appl. No.: 198,697

[22] Filed: May 24, 1988

[51] Int. Cl.[4] ..... A63B 71/02; A63B 49/00

[52] U.S. Cl. ..... 273/411; 273/67 R

[58] Field of Search ..... 273/411, 317, 329, 330, 273/340, 380, 428, 1 L, 58 H, 73 D, 76, 400, 67 R

[56] References Cited

U.S. PATENT DOCUMENTS

| | | | |
|---|---|---|---|
| Des. 160,005 | 9/1950 | Myles, Jr. . | |
| Des. 256,939 | 9/1980 | Castelli . | |
| Des. 258,000 | 1/1981 | Greenwood . | |
| Des. 278,073 | 3/1985 | Pozzi . | |
| 1,556,046 | 10/1925 | Taylor | 273/411 |
| 2,080,642 | 5/1937 | Timpe | 273/73 D |
| 2,156,477 | 5/1939 | Keller | 273/76 |
| 3,239,224 | 3/1966 | Finn et al. . | |
| 3,702,701 | 11/1972 | Vaughn et al. | 273/73 D |
| 3,820,785 | 6/1974 | Occhipinti et al. | 273/73 D X |
| 4,047,717 | 9/1977 | De Angelis | 273/400 |
| 4,240,396 | 12/1980 | Randoll | 273/428 X |
| 4,682,692 | 7/1987 | Kessler | 40/653 X |

FOREIGN PATENT DOCUMENTS

| | | | |
|---|---|---|---|
| 1050581 | 3/1979 | Canada | 273/73 C |
| 1133204 | 11/1956 | France | 273/76 |

*Primary Examiner*—William H. Grieb

*Attorney, Agent, or Firm*—Browdy and Neimark

[57] ABSTRACT

A kit for racket game includes a plurality of rubber balloons which can be inflated with water, a net and posts and a plurality of special rackets and a carrier, as well as at least one ball. The rackets have a rigid frame for holding on opposite sides with both hands by the player, the central area lying within the frame being either stringed with elastic strings in the nature of rubber bands or the like, or by an elastic cloth material, or by a rubber sheet or the like having holes cut therethrough to reduce wind resistance.

18 Claims, 6 Drawing Sheets

RACKET GAME FOR BEACH AND KIT THEREFOR

FIELD OF THE INVENTION

The present invention relates to entertainment; and more particularly it relates to a racket game especially adapted for the beach or field, and a kit therefor.

BACKGROUND OF THE INVENTION

Of course, many racket and/or net games may be played on an informal basis such as in the field or at the beach, including paddle ball, badminton and volleyball. Those games which, however, use paddles or rackets are limited to the type of projectile adapted for use with the racket or paddle. Similarly, for net games which do not use a racket, e.g. volleyball, the nature of the ball is also narrowly proscribed.

The need exists for an informal recreational game which can be played in the yard, field or at the beach, and which is easier to play than paddle ball, badminton or volleyball, and which is fun for the participants, and which automatically provides a penalty for the losing player or team.

SUMMARY OF THE INVENTION

It is, accordingly, and object of the present invention to overcome deficiencies in the prior art, such as indicated above.

It is another object to provide a new racket or paddle game adapted for informal play at the beach or in the field or yard.

It is a further object of the invention to provide a kit for such a racket or paddle game.

It is still another object of the invention to provide such a racket or paddle game which automatically penalizes the loser.

It is yet another object of the invention to provide a novel paddle especially adapted for such a new racket or paddle game.

It is yet a further object of the invention to provide such a paddle or racket game which can use water-filled balloons as the projectiles.

These and other objects and the nature and advantages of the instant invention will be more apparent from the following detailed description of certain embodiments thereof, taken in conjunction with the drawing, wherein:

DETAILED DESCRIPTION OF EMBODIMENTS

Figure 1:
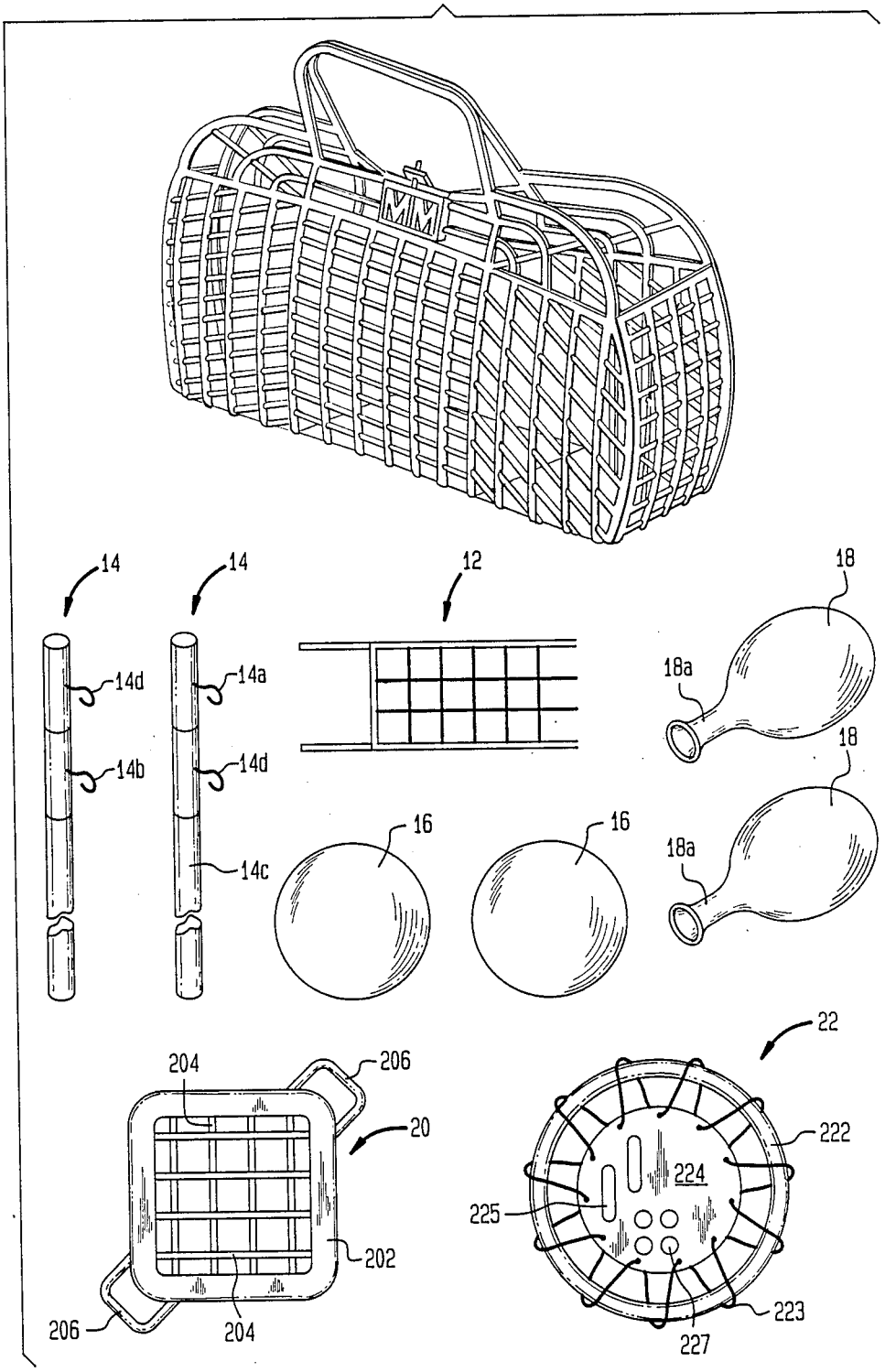
FIG. 1 is a partially schematic, exploded view of a kit in accordance with the present invention.

FIG. 1 shows a kit including a suitable carrier such as the carrier of the Kessler U.S. Pat. No. 4,682,692 and the various elements of the game of the present invention which will be carried within the carrier 10. These elements include a typical net 12 and at least two posts 14 which are preferably either telescopic or provided in sections 14a, 14b, 14c, etc., and desirably provided with suitable attachment means such as hooks 14d to which the net 12 can be attached. Also provided as part of the kit are suitable balls 16, e.g. two balls, desirably of diameter of 3.5–4 inches and preferably made of soft material, e.g. sponge rubber or plastic. Also provided are a plurality, e.g. 25–50, common elastic balloons 18, suitably formed of rubber, and having necks 18a which may be tied or otherwise sealed to prevent escape of water after such balloons have been filled with water.

Lastly, the kit contains at least two paddles or rackets 20, 22 which may take a variety of forms as shown in FIG. 1 and also in the remaining figures. Thus, the paddle or racket may have a wide variety of outside configurations, such as square as is the case with the racket 20, or circular as is the case with the racket 22, or hexagonal as is the case with the racket 24 of FIG. 2, or octagonal as is the case with the racket 26 of FIG. 3, or oblong as is case with the racket 28 of FIG. 4, or rectangular as is the case with the racket 30 of FIG. 5. Other external shapes are also possible.

Certain features of the paddle or racket, on the other hand, are quite important. First, it will be understood that the rackets 20, 22, 24, 26, 28, 30 are all two-handed rackets, and they are provided with either no handles whereby the player merely grasps opposite sides of the frame during use, or they are provided with oppositely located short handles as in the paddles 20 and 30, as is described in more detail below. In addition, the working surface of the paddle or racket, whether it be in the nature of "strings" or a solid surface, is elastic, as explained in more detail below.

Considering first the racket 20, it is provided with a rectangular frame 202 of tubular metal or plastic having either a circular or other cross section. The working surface of the paddle 20 comprises a plurality of crossing elastic "strings" 204 which are stretched between opposite sides of the frame 202, although other working surfaces such as described below in relation to other embodiments may be alternatively used. Suitable U-shaped handles 206 are provided on opposite corners, each intended to be grasped by a hand of the player during use, it being understood that the handles 206 may be eliminated if desired, or may be placed in other opposing locations. With regard to size, the frame 202 is suitably formed of 1 inch tubing and the distance across the frame is approximately 11–15 inches.

The racket 22 has a circular frame 222 of tubing material and a working surface comprising an elastomeric sheet 224, the elastomeric sheet 224 being connected to the frame 222 by a suitable string or cord 223. Because of air resistance, it is desirable when using a web or sheet 224 to provide air holes therethrough which may be in any desirable shape such as elongated holes 225 or circular holes 227. It will be understood that the sheet 224 can be replaced by an elastic fabric if desired; or the circular frame 22 can be used in conjunction with elastomeric strings as in the paddle 20. Or the circular frame 222 can be replaced by a frame of any other shape, in which case the circumference of the elastic web or sheet 224 will desirably be complementary to the other shape of the frame.

Figure 2:
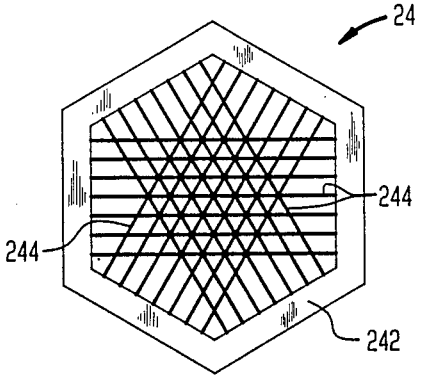
FIGS. 2–5 are plan view of some possible embodiments of paddles according to the present invention.
Figure 3:
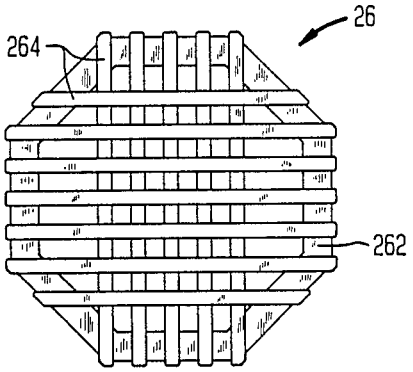

In the paddle or racket 24 of FIG. 2, the frame 242 has an hexagonal configuration, with suitable elastic strings 244 stretched in three directions thereacross. In the racket 26 of FIG. 3, the frame 26 is octagonal, with elastic strings 264 being stretched in opposite directions thereacross.

Figure 4:
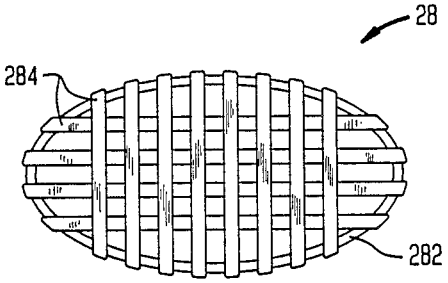
Figure 5:
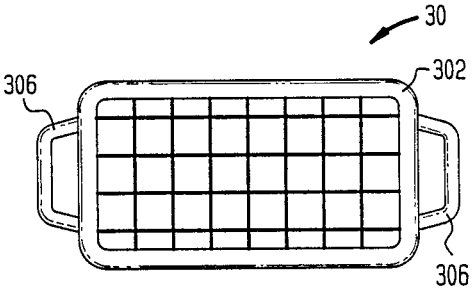

The paddle 28 of FIG. 4 has an oblong exterior shape defined by the generally ellipsoidal configuration of its outer frame 282. Its working surface is provided by elastic strings 284 stretched thereacross at right angles. The racket 30 of FIG. 5 is generally similar except that the outer frame 302 is rectangular and opposite handles 306 are provided. Again, as described above relative to the rackets 20 and 22, the embodiments of FIGS. 2–5 may be provided with or without opposite handles, and/or the elastic strings may be replaced by a suitable elastic web such as a rubber sheet or an elastic fabric.

Figure 6:
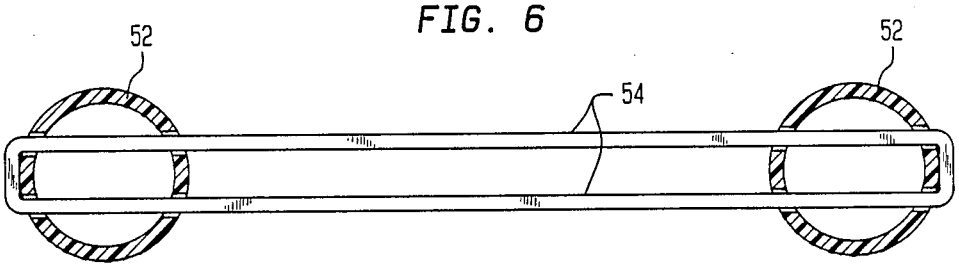
FIG. 6 is a schematic cross-sectional view of a paddle according to the present invention showing a possible stringing mode.

FIGS. 6 shows another preferred characteristic of the invention, i.e. the use of a double layer working surface. According to FIG. 6, an outer frame 52 is provided with superimposed horizontal holes extending therethrough, through which elastic strings such as in the nature of rubber bands 54 extend. The double layer configuration is in some respects more convenient and simpler to construct, and in another respect gives the construction a livelier response.

Figure 7:
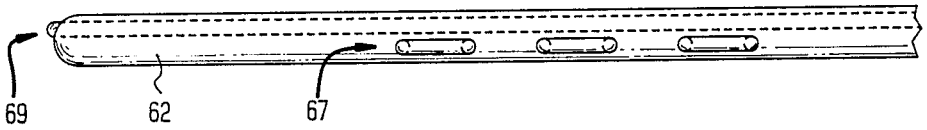
FIG. 7 is an edge view and FIG. 8 a partial plan view of another racket or paddle according to the present invention showing another stringing mode.
Figure 8:
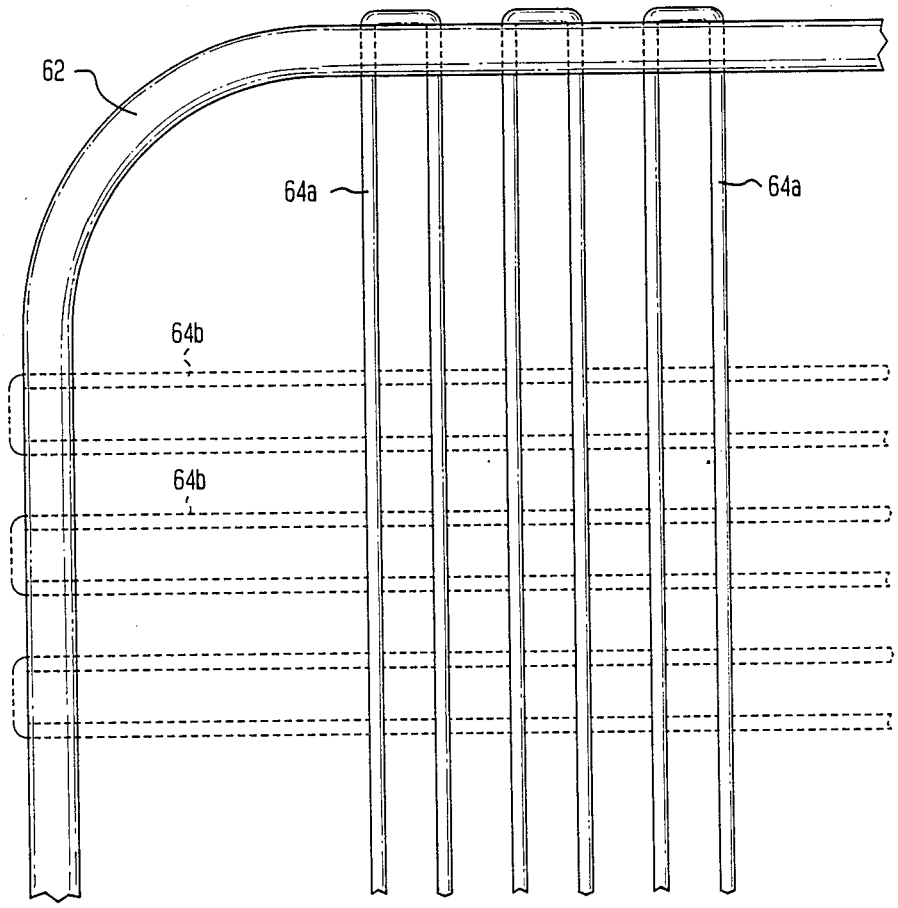

FIGS. 7 and 8 show another possible construction for the double layer stringing. Here the exterior frame member 62 has a plurality of horizontally extending openings at a first lower level 67 extending through the frame on opposite sides, and a second series of holes at a second level 69 of those portions of the frame 62 which extends at 90° from the first the first series of holes. With this construction, a first elastic string **64*a* may be strung through the frame 62 at a first level 67 in much the nature of the stringing of a badminton or tennis racket, except that the string is elastic. Then, at a second level 69, a second elastic string 64*b* may be strung at right angles to the first elastic string 64*a***.

Figure 9:
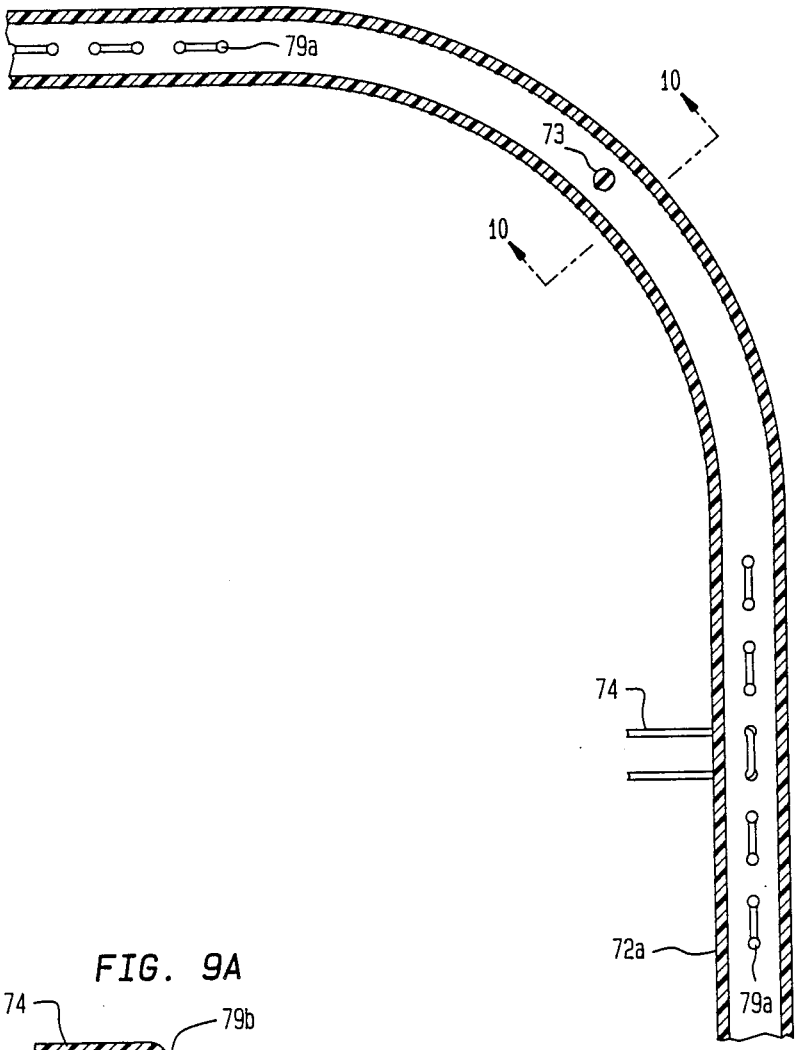
FIGS. 9–11 show yet another stringing mode, FIG. 9 being a partial plan view of a section of a racket, FIG. 9A being a sectional view through a completed frame embodying the frame part of FIG. 9, FIG. 10 being a cross-sectional view along line 10—10 of FIG. 9, and FIG. 11 being a cross-sectional view through a completed and strong frame of the type shown in FIGS. 9 and 10.
Figure 10:
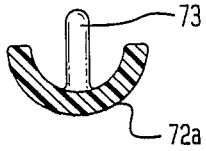
Figure 11:
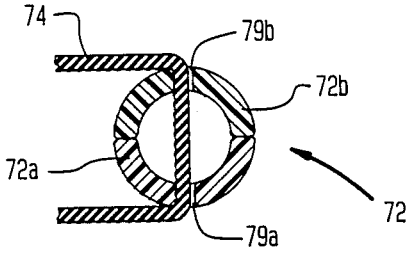

FIGS. 9–11 show another variation. Here the outer frame 72 is formed in two halves, a lower half **72*a* and a top half 72*b*. Each of these halves 72*a* and 72*b* are provided with a series of strategic placed interconnecting fastening elements 73, the half 72*a* showing a male fastening element 73 in FIG. 10. The half 72*b* will consequently have a mating female element (not shown) into which the male element 73** snap fits to provide a strong and integral connection.

Figure 9A:
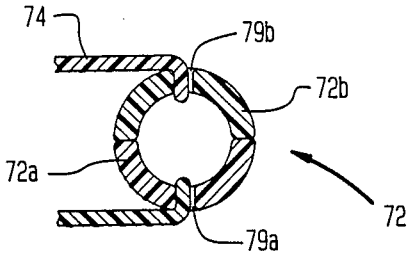

As especially seen in FIGS. 9 and 11, the two frame halves **72*a* and 72*b* are provided with vertically extending through holes 79*a* and 79*b* through which the elastic strings 74 may be strung either as shown FIG. 9 or as shown in FIG. 11. The type of stringing shown in FIG. 9 is, of course, the kind typically found in tennis and badminton rackets or the like, with the exception that the string 74 is elastic in the present invention. Also, as already indicated above, the FIG. 9 construction can be provided with a double working layer of strings 75 by similarly stringing a second elastic string 74 through holes equivalent to the holes 79*b* of FIG. 11 in the opposite half of the frame 72*b* as shown in FIG. 9A. FIG. 11 shows a second way of stringing the frame 72 in a way analogous to that shown in FIG. 6**.

Figure 12:
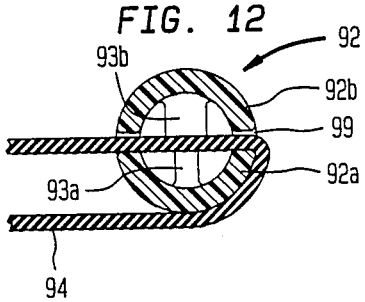
FIG. 12 is a cross-sectional view similar to FIG. 7 showing still another variation.

The embodiment of FIG. 12 is a variation of that of FIGS. 9–12 in that the frame 92 again comprises a top half **92*b* and a bottom half 92*a*. These parts snap together as in the embodiment of FIGS. 9–11 by the cooperation of a male element 93*a* and a female element 93*b*. In this construction, however, appropriate horizontal through holes 99, through which the elastic strings 94 pass, are provided at the interface between the frame halves 92*a* and 92*b***.

Figure 13:
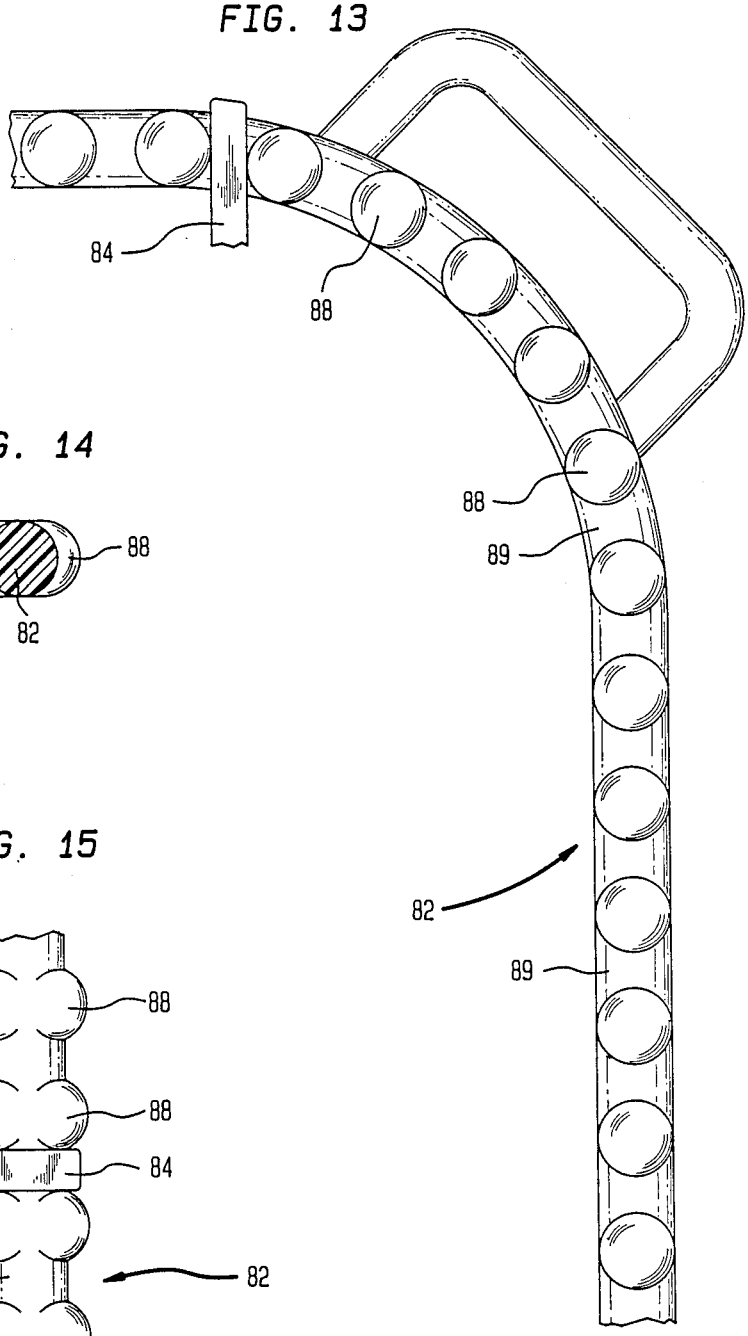
FIGS. 13–15 show still another frame, FIG. 13 being a partial plan view, FIG. 14 being a sectional view through the frame, and FIG. 15 being a partial edge view.
Figure 14:
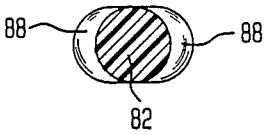
Figure 15:
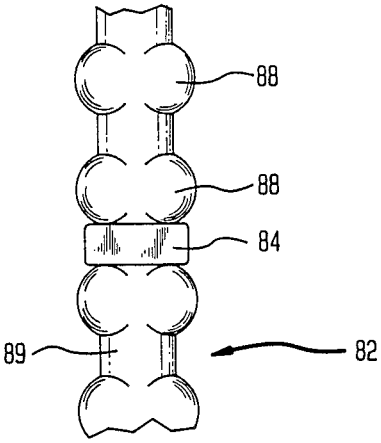

In the embodiments of FIGS. 13–15, the frame 82 may be provided with a solid core as shown in cross section in FIG. 14, which may be of metal, plastic or composite (e.g. fiber glass or graphite) material. Significantly, however, the exterior configuration of the outer frame 82 is provided with a series of projections or protuberances 88 defining therebetween generally saddle-shaped depressions 89. These generally saddle-shaped depressions 89 in turn form a seat for the elastic strings 84 which merely pass about the exterior of the frame 82. This embodiment is particularly easy to "string" by merely stretching appropriately sized rubber bands about the exterior of the frame so as to extend from one side of the frame 82 to the other side thereof. The elastic strings 84 resist displacement laterally along the frame 82 by virtue of being seated between the protrusions 88.

Use of equipment according to the present invention may take a variety of forms. At the beach, a plurality of rubber balloons 18 may be filled with water and the water-filled balloons used as projectiles to play the game. One or more players assemble on each side of the net 12. A paddle or racket is grasped on opposite sides by both hands of each player. Serving may be accomplished by either throwing a water-filled balloon into the air or by launching same at rest from the working surfac eof a paddle or racket. The elastic working surface of the paddle or racket effects a substantial movement of the water-filled rubber balloon. A substantialy impact from the working surface of a paddle can launch the balloon very high over the net, but it can also cause the balloon to burst dousing the player with water. On the other hand, if the water-filled balloon is successively launched without bursting, then a greater inertia imparted to the water-filled balloon will increase the chances of an opposing player being doused with water as the balloon reaches the other side of the net.

Soft balls 16 are provided for use when the game is played in the yard or on a field, or when the supply of balloons has become temporarily exhausted. The game can be played informally or formally.

It is to be understood that the invention is not limited to the embodiments disclosed which are illustratively offered and that modifications may be made without departing from the invention.

What is claimed is:

1. A racket game kit including (i) a plurality of inflatable elastic balloons, each capable of being inflated with water and each having a mouth portion which can be closed;

(ii) a net comprising an open weave cloth, and posts for fixing said net in position so as to define two opposite courts separated by said net;

(iii) at least one soft generally spherical ball;

(iv) a plurality of rackets, each said racket having a rigid frame adapted to be held by both hands on opposite sides and defining an interior space, and an elastic member within said interior space and supported by said rigid frame, said elastic member being selected from the group consisting of an elastomeric web having openings therethrough and a plurality of elastomeric strings; and (v) a carrier therefor.

2. A racket game kit according to claim 1 including two soft generally spherical balls having a diameter of about 3.5 to about 4 inches.

3. A racket game kit according to claim 1 wherein said elastic member of each said racket comprises two superimposed layers.

4. A racket game kit according to claim 3 wherein said elastic member constitutes a plurality of crossing elastomeric strings.

5. A racket game kit according to claim 1 wherein said elastic member constitutes a plurality of crossing elastomeric strings.

6. A racket game kit according to claim 1 wherein said paddles are each provided with a pair of generally U-shaped handles on opposite sides thereof.

7. A game racket comprising a rigid exterior frame adapted to be held by both hands on opposite sides thereof, said frame defining an open interior space, and an elastic member within and extending across said open interior space and supported by said rigid frame, said elastic member comprising two superimposed layers, each layer comprising crossing elastomeric strings.

8. A racket according to claim 7 wherein said frame is provided with a pair of generally U-shaped handles on opposite sides thereof.

9. A racket according to claim 7 wherein said rigid frame is formed of tubing.

10. A racket according to claim 7 wherein said rigid frame has stringing holes extending therethrough.

11. A racket according to claim 10, said rigid frame having side-by-side pairs of said stringing holes extending therethrough and spaced along said frame.

12. A racket according to claim 11 wherein said plate of holes extend horizontally through said frame.

13. A racket according to claim 10 wherein said holes extends horizontally through said frame.

14. A racket according to claim 10 wherein said holes are disposed vertically through said frame.

15. A racket according to claim 7 wherein said rigid frame is provided with a plurality of protuberances along its surface, adjacent protuberances defining recesses therebetween, said elastic member comprising a plurality of elastomeric strings extending about said frame and resting on said frame within said recesses.

16. A racket according to claim 7 wherein said rigid frame is formed of two half-tubings fixed together to provide a hollow tubing, said hollow tubing having stringing holes extending therethrough.

17. A racket according to claim 16 wherein said holes extend parallel to the plane of said racket.

18. A racket according to claim 16 wherein said holes extend perpendicular to the plane of said racket.

* * * * *